US011566296B2

(12) United States Patent
Leunis et al.

(10) Patent No.: US 11,566,296 B2
(45) Date of Patent: Jan. 31, 2023

(54) METHOD OF PRODUCTION OF TIN CONTAINING NON GRAIN-ORIENTED SILICON STEEL SHEET, STEEL SHEET OBTAINED AND USE THEREOF

(71) Applicant: ArcelorMittal, Luxembourg (LU)

(72) Inventors: Elke Leunis, Kalken (BE); Tom Van De Putte, Sinaai (BE); Sigrid Jacobs, Merelbeke (BE); Wahib Saikaly, Woluwe-Saint-Pierre (BE)

(73) Assignee: ARCELORMITTAL, Luxembourg (LU)

( * ) Notice: Subject to any disclaimer, the term of this patent is extended or adjusted under 35 U.S.C. 154(b) by 843 days.

(21) Appl. No.: 15/520,243

(22) PCT Filed: Oct. 20, 2015

(86) PCT No.: PCT/IB2015/001944
§ 371 (c)(1),
(2) Date: Apr. 19, 2017

(87) PCT Pub. No.: WO2016/063118
PCT Pub. Date: Apr. 28, 2016

(65) Prior Publication Data

US 2017/0314087 A1 Nov. 2, 2017

(30) Foreign Application Priority Data

Oct. 20, 2014 (WO) ..... PCT/IB2014/002174

(51) Int. Cl.

| | |
|---|---|
| ***C21D 8/12*** | (2006.01) |
| ***C22C 38/00*** | (2006.01) |
| ***C21D 9/46*** | (2006.01) |
| ***C22C 38/06*** | (2006.01) |
| ***C22C 38/38*** | (2006.01) |
| ***H01F 1/16*** | (2006.01) |
| ***C22C 38/02*** | (2006.01) |
| ***C22C 38/04*** | (2006.01) |
| ***C22C 38/14*** | (2006.01) |
| *C21D 9/56* | (2006.01) |

(52) U.S. Cl.
CPC ..... *C21D 8/1222* (2013.01); *C21D 8/12* (2013.01); *C21D 8/1233* (2013.01); *C21D 8/1244* (2013.01); *C21D 8/1272* (2013.01); *C21D 9/46* (2013.01); *C22C 38/00* (2013.01); *C22C 38/001* (2013.01); *C22C 38/004* (2013.01); *C22C 38/008* (2013.01); *C22C 38/02* (2013.01); *C22C 38/04* (2013.01); *C22C 38/06* (2013.01); *C22C 38/14* (2013.01); *C22C 38/38* (2013.01); *H01F 1/16* (2013.01); *C21D 9/56* (2013.01); *C21D 2211/005* (2013.01)

(58) Field of Classification Search
CPC ..... C22C 38/004
See application file for complete search history.

(56) References Cited

U.S. PATENT DOCUMENTS

| | | | | |
|---|---|---|---|---|
| 5,009,726 | A | 4/1991 | Nishimoto et al. | |
| 5,116,436 | A | 5/1992 | Nishimoto et al. | |
| 5,803,988 | A | 9/1998 | Bae et al. | |
| 6,322,639 | B1 * | 11/2001 | Matsuzaki | C22C 38/02 148/308 |
| 6,503,339 | B1 * | 1/2003 | Pircher | C21D 8/1222 148/120 |
| 6,582,528 | B1 | 6/2003 | Boehm et al. | |
| 6,773,514 | B1 * | 8/2004 | Kawalla | C21D 8/1222 148/111 |
| 7,846,271 | B2 | 12/2010 | Choi et al. | |
| 7,867,344 | B2 | 1/2011 | Kusumi et al. | |
| 8,157,928 | B2 | 4/2012 | Tanaka | |
| 8,591,671 | B2 * | 11/2013 | Shimazu | C22C 38/02 148/309 |
| 9,570,219 | B2 | 2/2017 | Natori et al. | |
| 2006/0185767 | A1 | 8/2006 | Arita et al. | |
| 2008/0121314 | A1 * | 5/2008 | Choi | C22C 38/06 148/111 |
| 2009/0202383 | A1 * | 8/2009 | Tanaka | C22C 38/06 420/83 |
| 2010/0300585 | A1 | 12/2010 | Perlade et al. | |
| 2012/0267015 | A1 | 10/2012 | Kim et al. | |
| 2012/0285584 | A1 | 11/2012 | Wang | |

(Continued)

FOREIGN PATENT DOCUMENTS

| | | | |
|---|---|---|---|
| EP | 0019849 | A1 | 12/1980 |
| EP | 0866144 | B1 | 11/2005 |

(Continued)

OTHER PUBLICATIONS

Machine Translation JP 2013-91837 A (Year: 2020).*
Search report of PCT/IB2015/001944 dated Feb. 25, 2016, 2 pages.
S. K. Chang et al., "Texture Effect on Magnetic Properties by Alloying Specific Elements in Non-grain Silicon Steels", ISIJ International, (2005), vol. 45, No. 6, doi:10.2355/isijinternational.45.918, pp. 918-922, XP055273362.

(Continued)

*Primary Examiner* — Alexandra M Moore

(74) *Attorney, Agent, or Firm* — Davidson, Davidson & Kappel, LLC

(57) ABSTRACT

A method of production non grain-oriented Fe—Si steel sheet is provided. The method includes the steps of melting a steel composition that contains in weight percentage: C≤0.006, 2.0≤Si≤5.0, 0.1≤Al≤3.0, 0.1≤Mn≤3.0, N≤0.006, 0.04≤Sn≤0.2, S≤0.005, P≤0.2, Ti≤0.01, the balance being Fe and other inevitable impurities, casting said melt into a slab, reheating said slab, hot rolling said slab, coiling said hot rolled steel, optionally annealing the hot rolled steel, cold rolling, annealing and cooling the cold rolled steel down to room temperature.

21 Claims, No Drawings

(56) References Cited

U.S. PATENT DOCUMENTS

| | | | | |
|---|---|---|---|---|
| 2013/0183192 | A1* | 7/2013 | Hill | C21D 8/0236 420/103 |
| 2013/0306200 | A1 | 11/2013 | Kohno | |

FOREIGN PATENT DOCUMENTS

| | | | | |
|---|---|---|---|---|
| EP | 2602335 | | 6/2013 | |
| EP | 2799573 | B1 | 6/2020 | |
| JP | 2000129409 | A | 5/2000 | |
| JP | 2002146493 | | 5/2002 | |
| JP | 2006219692 | | 8/2006 | |
| JP | 2008127600 | A | 6/2008 | |
| JP | 2008127612 | | 6/2008 | |
| JP | 2008524449 | A | 7/2008 | |
| JP | 2013001837 | | 1/2013 | |
| JP | 2013-91837 | A * | 5/2013 | C21D 8/12 |
| JP | 2013515170 | A | 5/2013 | |
| KR | 100240993 | B1 * | 3/2000 | |
| RU | 2134727 | C1 | 8/1999 | |
| RU | 2320734 | C2 | 3/2008 | |
| RU | 2398894 | C1 | 9/2010 | |
| RU | 2527827 | A | 9/2014 | |
| WO | WO00/65103 | | 11/2000 | |
| WO | WO01/02610 | | 1/2001 | |
| WO | 2006068399 | A1 | 6/2006 | |
| WO | WO2016063118 | A1 | 4/2016 | |

OTHER PUBLICATIONS

De Araujo Cardosoa Rodrigo Felix, et al., "Influence of Grain Size and Additions of A1 and Mn on Magnetic Properties of Non-Oriented Electrical Steels with 3 wt.(%) Si", Materials Research, (2008), vol. 11, No. 1, pp. 51-55, XP055851718.

Schneider J, et al, "Evolution of Microstructure and texture along the processing route of ferritic nonoriented FeSi Steels", Proc. 5. International Conference Magnetism and Metallurgy WMM14, (2014), pp. 208-224, XP055851721.

* cited by examiner

METHOD OF PRODUCTION OF TIN CONTAINING NON GRAIN-ORIENTED SILICON STEEL SHEET, STEEL SHEET OBTAINED AND USE THEREOF

The present invention relates to a method of production of Fe—Si electrical steel sheets exhibiting magnetic properties. Such material is used, for instance, in the manufacturing of rotors and/or stators for electric motors for vehicles.

BACKGROUND

Imparting magnetic properties to Fe—Si steel is the most economical source of magnetic induction. From a chemical composition standpoint, adding silicon to iron is a very common way to increase electrical resistivity, hence improving magnetic properties, and reducing at the same time the total power losses. Two families presently co-exist for the construction of steels for electrical equipment: grain-oriented and non grain-oriented steels.

Non grain-oriented steels have the advantage of possessing magnetic properties that are nearly equivalent in all the magnetizing directions. As a consequence, such material is more adapted for applications that require rotative movements such as motors or generators for instance.

The following properties are used to evaluate the efficiency of electrical steels when it comes to magnetic properties:

- the magnetic induction, expressed in Tesla. This induction is obtained under specific magnetic field expressed in A/m. The higher the induction, the better.
- the core power loss, expressed in W/kg, is measured at a specific polarization expressed in Tesla (T) using a frequency expressed in Hertz. The lower the total losses, the better.

Many metallurgical parameters may influence the above mentioned properties, the most common ones being: the alloying content, material texture, the ferritic grain size, precipitates size and distribution, and the material thickness. Henceforth, the thermo-mechanical processing from the cast to the final cold rolled steel annealing is essential to reach the targeted specifications.

JP201391837 discloses a method for producing an electromagnetic steel sheet which comprises 0.0030% or less of C, 2.0-3.5% of Si, 0.20-2.5% of Al, 0.10-1.0% of Mn, and 0.03-0.10% of Sn, wherein Si+Al+Sn≤4.5%. Such steel is subjected to hot rolling, and then primary cold rolling with a rolling rate of 60-70% to produce a steel sheet with a middle thickness. Then, the steel sheet is subjected to process annealing, then secondary cold rolling with a rolling rate of 55-70%, and further final annealing at 950° C. or more for 20-90 seconds. Such method is rather energy consuming and involves a long production route.

JP2008127612 relates to a non grain-oriented electromagnetic steel sheet having a chemical composition comprising, by mass %, 0.005% or less C, 2 to 4% Si, 1% or less Mn, 0.2 to 2% Al, 0.003 to 0.2% Sn, and the balance Fe with unavoidable impurities. The non grain-oriented electromagnetic steel sheet with a thickness of 0.1 to 0.3 mm is manufactured by the steps of: cold-rolling the hot-rolled plate before and after an intermediate annealing step and subsequently recrystallization-annealing the sheet. Such processing route is as for the first application detrimental to productivity since it involves a long production route.

SUMMARY OF THE INVENTION

It appears that a need remains for a production method of such FeSi steels that would be simplified and more robust while not comprising on power loss and induction properties.

The steel according to the invention follows a simplified production route to reach good compromises of power loss and induction. Furthermore, tool wear is limited with the steel according to the invention.

It is an object of the present invention to provide a method of production of annealed cold-rolled non grain-oriented Fe—Si steel sheet consisting of the successive following steps:

melting a steel composition that contains in weight percentage:

C≤0.006
2.0≤Si≤5.0
0.1≤Al≤3.0
0.1≤Mn≤3.0
N≤0.006
0.04≤Sn≤0.2
S≤0.005
P≤0.2
Ti≤0.01 the balance being Fe and other inevitable impurities casting said melt into a slab reheating said slab at a temperature between 1050° C. and 1250° C.

hot rolling said slab with a hot rolling finishing temperature between 750° C. and 950° C. to obtain a hot rolled steel band, coiling said hot rolled steel band at a temperature between 500° C. and 750° C. to obtain a hot band optionally, the hot rolled steel band is annealed at a temperature between 650° C. and 950° C. for a time between 10 s and 48 hours cold rolling the hot rolled steel band to obtain a cold rolled steel sheet heating the cold rolled steel sheet up to a soaking temperature between 850° C. and 1150° C.

holding the cold rolled steel sheet at the soaking temperature for a time between 20 s and 100 s cooling the cold rolled steel sheet down to room temperature to obtain an annealed cold rolled steel sheet.

In a preferred embodiment, the method of production of non grain-oriented Fe—Si steel sheet according to the invention has a silicon content such that: 2.0≤Si≤3.5, even more preferably, 2.2≤Si≤3.3.

In a preferred embodiment, the method of production of non grain-oriented Fe—Si steel sheet according to the invention has an aluminum content such that: 0.2≤Al≤1.5, even more preferably, 0.25≤Al≤1.1.

In a preferred embodiment, the method of production of non grain-oriented Fe—Si steel sheet according to the invention has a manganese content such that: 0.1≤Mn≤1.0.

Preferably, the method of production of non grain-oriented Fe—Si steel sheet according to the invention has a tin content such that: 0.07≤Sn≤0.15, even more preferably, 0.11≤Sn≤0.15.

In another preferred embodiment, the method of production of non grain-oriented Fe—Si steel sheet according to the invention involves an optional hot band annealing done using a continuous annealing line.

In another preferred embodiment, the method of production of non grain-oriented Fe—Si steel sheet according to the invention involves an optional hot band annealing done using a batch annealing.

In a preferred embodiment, the soaking temperature is between 900 and 1120° C.

In another embodiment, the non grain-oriented cold rolled annealed steel sheet according to the invention is coated.

Another object of the invention is the non grain-oriented steel obtained using the method of the invention.

High efficiency industry motors, generators for electricity production, motors for electrical vehicles using the non grain-oriented steel produced according to the invention are also an object of the invention as well as motors for hybrid vehicle using the non grain-oriented steel produced according to the invention.

DETAILED DESCRIPTION

In order to reach the desired properties, the steel according to the invention includes the following chemical composition elements in weight percent:

Carbon in an amount limited to 0.006 included. This element can be harmful because it can provoke steel ageing and/or precipitation which would deteriorate the magnetic properties. The concentration should therefore be limited to below 60 ppm (0.006 wt %).

Si minimum content is 2.0% while its maximum is limited to 5.0%, both limits included. Si plays a major role in increasing the resistivity of the steel and thus reducing the Eddy current losses. Below 2.0 wt % of Si, loss levels for low loss grades are hard to achieve. Above 5.0 wt % Si, the steel becomes fragile and subsequent industrial processing becomes difficult. Consequently, Si content is such that: 2.0 wt %≤Si≤5.0 wt %, in a preferred embodiment, 2.0 wt %≤Si≤3.5 wt %, even more preferably, 2.2 wt %≤Si≤3.3 wt %.

Aluminium content shall be between 0.1 and 3.0%, both included. This element acts in a similar way to that of silicon in terms of resistivity effect. Below 0.1 wt % of Al, there is no real effect on resistivity or losses. Above 3.0 wt % Al, the steel becomes fragile and subsequent industrial processing becomes difficult. Consequently, Al is such that: 0.1 wt %≤Al≤3.0 wt %, in a preferred embodiment, 0.2 wt %≤Al≤1.5 wt %, even more preferably, 0.25 wt %≤Al≤1.1 wt %.

Manganese content shall be between 0.1 and 3.0%, both included. This element acts in a similar way to that of Si or Al for resistivity: it increases resistivity and thus lowers Eddy current losses. Also, Mn helps harden the steel and can be useful for grades that require higher mechanical properties. Below 0.1 wt % Mn, there is not a real effect on resistivity, losses or on mechanical properties. Above 3.0 wt % Mn, sulphides such as MnS will form and can be detrimental to core losses. Consequently, Mn is such that 0.1 wt %≤Mn≤3.0 wt %, in a preferred embodiment, 0.1 wt %≤Mn≤1.0 wt %, Just as carbon, nitrogen can be harmful because it can result in AlN or TiN precipitation which can deteriorate the magnetic properties. Free nitrogen can also cause ageing which would deteriorate the magnetic properties. The concentration of nitrogen should therefore be limited to 60 ppm (0.006 wt %).

Tin is an essential element of the steel of this invention. Its content must be between 0.04 and 0.2%, both limits included. It plays a beneficial role on magnetic properties, especially through texture improvement. It helps reduce the (111) component in the final texture and by doing so it helps improve magnetic properties in general and polarization/induction in particular. Below 0.04 wt % of tin, the effect is negligible and above 0.2 wt %, steel brittleness will become an issue. Consequently, tin is such that: 0.04 wt %≤Sn≤0.2 wt %, in a preferred embodiment, 0.07 wt %≤Sn≤0.15 wt %.

Sulphur concentration needs to be limited to 0.005 wt % because S might form precipitates such as MnS or TiS that would deteriorate magnetic properties.

Phosphorous content must be below 0.2 wt %. P increases resistivity which reduces losses and also might improve texture and magnetic properties due to the fact that is a segregating element that might play a role on recrystallization and texture. It can also increase mechanical properties. If the concentration is above 0.2 wt %, industrial processing will be difficult due to increasing fragility of the steel. Consequently, P is such that P≤0.2 wt % but in a preferred embodiment, to limit segregation issues, P≤0.05 wt %.

Titanium is a precipitate forming element that may form precipitates such as: TiN, TiS, $Ti_4C_2S_2$, Ti(C,N), and TiC that are harmful to the magnetic properties. Its concentration should be below 0.01 wt %.

The balance is iron and unavoidable impurities such as the ones listed here below with their maximum contents allowed in the steel according to the invention:

Nb≤0.005 wt %
V≤0.005 wt %
Cu≤0.030 wt %
Ni≤0.030 wt %
Cr≤0.040 wt %
B≤0.0005

Other possible impurities are: As, Pb, Se, Zr, Ca, O, Co, Sb, and Zn, that may be present at traces level.

The cast with the chemical composition according to the invention is afterwards reheated, the Slab Reheating Temperature (SRT) lying between 1050° C. and 1250° C. until the temperature is homogeneous through the whole slab. Below 1050° C., rolling becomes difficult and forces on the mill will be too high. Above 1250° C., high silicon grades become very soft and might show some sagging and thus become difficult to handle.

Hot rolling finishing temperature plays a role on the final hot rolled microstructure and takes place between 750 and 950° C. When the Finishing Rolling Temperature (FRT) is below 750° C., recrystallization is limited and the microstructure is highly deformed. Above 950° C. would mean more impurities in solid solution and possible consequent precipitation and deterioration of magnetic properties as well.

The Coiling Temperature (CT) of the hot rolled band also plays a role on the final hot rolled product; it takes place between 500° C. and 750° C. Coiling at temperatures below 500° C. would not allow sufficient recovery to take place while this metallurgical step is necessary for magnetic properties. Above 750° C., a thick oxide layer would appear and it will cause difficulties for subsequent processing steps such as cold rolling and/or pickling.

The hot rolled steel band presents a surface layer with Goss texture having orientation component as {110}<100>, the said Goss texture being measured at 15% thickness of the hot rolled steel band. Goss texture provides the band with enhanced magnetic flux density thereby decreasing the core loss which is well evident from Table 2, 4 and 6 provided hereinafter. The nucleation of Goss texture is promoted during hot rolling by keeping the finishing rolling temperature above 750 degree Celsius.

The thickness of the hot strip band varies from 1.5 mm to 3 mm. It is difficult to get a thickness below 1.5 mm by the usual hot rolling mills. Cold rolling from more than 3 mm thick band down to the targeted cold rolled thickness would strongly reduce productivity after the coiling step and that would also deteriorate the final magnetic properties.

The optional Hot Band Annealing (HBA) can be performed at temperatures between 650° C. and 950° C., this step is optional. It can be a continuous annealing or a batch annealing. Below a soaking temperature of 650° C., recrystallization will not be complete and the improvement of final magnetic properties will be limited. Above a soaking temperature 950° C., recrystallized grains will become too large and the metal will become brittle and difficult to handle during the subsequent industrial steps. The duration of the soaking will depend on whether it is continuous annealing (between 10 s and 60 s) or batch annealing (between 24 h and 48 h). Afterwards, the band (annealed or not) is cold rolled. In this invention, cold rolling is done in one step i.e without intermediate annealing.

Pickling can be done before or after the annealing step.

Finally, the cold rolled steel undergoes a final annealing at a temperature (FAT) lying between 850° C. and 1150° C., preferably between 900 and 1120° C., for a time between 10 and 100 s depending on the temperature used and on the targeted grain size. Below 850° C., recrystallization will not be complete and losses will not reach their full potential. Above 1150° C., grain size will be too high and induction will deteriorate. As for the soaking time, below 10 seconds, not enough time is given for recrystallization whereas above 100 s the grain size will be too big and will negatively affect the final magnetic properties such as the induction level.

The Final Sheet Thickness (FST) is between 0.14 mm and 0.67 mm.

The microstructure of the final sheet produced according to this invention contains ferrite with grain size between 30 μm and 200 μm. Below 30 μm, the losses will be too high while above 200 μm, the induction level will be too low.

As for mechanical properties, the yield strength will be between 300 MPa and 480 MPa, while ultimate tensile strength shall be between 350 MPa and 600 MPa.

The following examples are for the purposes of illustration and are not meant to be construed to limit the scope of the disclosure herein:

Example 1

Two laboratory heats were produced with the compositions given in the table 1 below. The underlined values are not according to the invention. Then, successively: hot rolling was done after reheating the slabs at 1150° C. The finished rolling temperature was 900° C. and the steels were coiled at 530° C. The hot bands were batch annealed at 750° C. during 48 h. The steels were cold rolled down to 0.5 mm. No intermediate annealing took place. The final annealing was done at a soaking temperature of 1000° C. and the soaking time was 40 s.

TABLE 1 chemical composition in weight % of heats 1 and 2

| Element (wt %) | Heat 1 | Heat 2 |
|---|---|---|
| C | 0.0024 | 0.0053 |
| Si | 2.305 | 2.310 |
| Al | 0.45 | 0.50 |

TABLE 1-continued chemical composition in weight % of heats 1 and 2

| Element (wt %) | Heat 1 | Heat 2 |
|---|---|---|
| Mn | 0.19 | 0.24 |
| N | 0.001 | 0.0021 |
| Sn | <u>0.005</u> | 0.12 |
| S | 0.0049 | 0.005 |
| P | <0.05% | <0.05% |
| Ti | 0.0049 | 0.0060 |

Magnetic measurements were done on both of these heats. Total magnetic losses at 1.5 T and 50 Hz as well as the induction B5000 were measured and the results are shown in the table below. It can be seen that Sn addition results in a significant improvement of magnetic properties using this processing route.

TABLE 2

Magnetic properties of heats 1 and 2

| | Heat 1 | Heat 2 |
|---|---|---|
| Losses at 1.5T/50 Hz (W/Kg) | 2.98 | 2.92 |
| B5000 (T) | 1.663 | 1.695 |

Example 2

Two heats were produced with the compositions given in the table 3 below. The underlined values are not according to the invention. Hot rolling was done after reheating the slabs at 1120° C. The finishing rolling temperature was 870° C., coiling temperature was 635° C. The hot bands were batch annealed at 750° C. during 48 h. Then cold rolling took place down to 0.35 mm. no intermediate annealing took place. The final annealing was done at a soaking temperature of 950° C. and the soaking time was 60 s.

TABLE 3 chemical composition in weight % of heats 3 and 4

| Element (wt %) | Heat 3 | Heat 4 |
|---|---|---|
| C | 0.0037 | 0.0030 |
| Si | 2.898 | 2.937 |
| Al | 0.386 | 0.415 |
| Mn | 0.168 | 0.135 |
| N | 0.0011 | 0.0038 |
| Sn | <u>0.033</u> | 0.123 |
| S | 0.0011 | 0.0012 |
| P | 0.0180 | 0.0165 |
| Ti | 0.0049 | 0.0041 |

Magnetic measurements were done on both of these heats. Total magnetic losses at 1.5 T and 50 Hz as well as the induction B5000 were measured and the results are shown in the table below. It can be seen that Sn addition results in a significant improvement of magnetic properties using this processing route.

TABLE 4

| Magnetic properties of heats 3 and 4 | | |
|---|---|---|
| | Heat 3 | Heat 4 |
| Losses at 1.5T/50 Hz (W/Kg) | 2.40 | 2.34 |
| B5000 (T) | 1.666 | 1.688 |

Example 3

Two heats were produced with the compositions given in the table 5 below. The underlined values are not according to the invention. Then, successively: hot rolling was done after reheating the slabs at 1150° C. The finished rolling temperature was 850° C. and the steels were coiled at 550° C. The hot bands were batch annealed at 800° C. during 48 h. The steels were cold rolled down to 0.35 mm. No intermediate annealing took place. The final annealing was done at a soaking temperature of 1040° C. and the soaking time was 60 s.

TABLE 5

| chemical composition in weight % of heats 5 and 6 | | |
|---|---|---|
| Element (wt %) | Heat 5 | Heat 6 |
| C | 0.002 | 0.0009 |
| Si | 3.30 | 3.10 |
| Al | 0.77 | 0.61 |
| Mn | 0.20 | 0.21 |
| N | 0.0004 | 0.0014 |
| Sn | <u>0.006</u> | 0.076 |
| S | 0.0004 | 0.0012 |
| P | ≤0.05 | ≤0.05 |
| Ti | 0.0015 | 0.0037 |
| Resistivity (μΩcm) | 55.54 | 53.07 |

Magnetic measurements were done on both of these heats. Total magnetic losses at 1.5 T and 50 Hz, at 1 T and 400 Hz as well as the induction B5000 were measured and the results are shown in the table below. It can be seen that 0.07 wt % Sn addition results in an improvement of magnetic properties using this processing route.

TABLE 6

| Magnetic properties of heats 5 and 6 | | |
|---|---|---|
| | Heat 5 | Heat 6 |
| Losses at 1.5T/50 Hz (W/Kg) | 2.17 | 2.12 |
| B5000 (T) | 1.673 | 1.682 |

As can be seen, from both of these examples, Sn improves magnetic properties using the metallurgical route according to the invention with different chemical compositions.

The steel obtained with the method according to the invention can be used for motors of electric or hybrid cars, for high efficiency industry motors as well as for generators for electricity production.

What is claimed is:

1. A cold-rolled, non grain-oriented steel sheet having a composition that contains in weight percentage:

C≤0.006%,
2.0%≤Si≤5.0%,
0.1%≤Al≤3.0%,
0.1%≤Mn≤3.0%,
N≤0.006%,
0.04%≤Sn≤0.2%,
S≤0.005%,
P≤0.2%,
Ti≤0.01%,
Cr≤0.040%,
Cu≤0.030 wt %, and
Ni≤0.030 wt %,
wherein the elements Mn and Al satisfy an equation of Mn−Al≤−0.26,
the balance being Fe and inevitable impurities;

the sheet comprising ferrite, all the ferrite grains of the sheet having a grain size between 30 μm and 200 μm; the sheet having a yield strength between 300 MPa and 480 MPa, and an ultimate tensile strength between 350 MPa and 600 MPa, wherein the total core power losses, measured at a polarization of 1.5 T and using a frequency of 50 Hz, is below or equal to 2.34 W/kg.

2. The cold-rolled, non grain-oriented steel sheet according to claim 1, comprising:

a sheet thickness (FST) between 0.14 mm and 0.67 mm.

3. The cold-rolled, non grain-oriented steel sheet according to claim 1, wherein the composition contains in weight percentage:

C≤0.0030%,
2.937%≤Si≤3.10%,
0.415%≤Al≤0.61%,
0.135%≤Mn≤0.21%,
N≤0.0038%,
0.076%≤Sn≤0.123%,
S≤0.0012%,
P≤0.05%, and
Ti≤0.0041%.

4. The cold-rolled, non grain-oriented steel sheet according to claim 1, wherein the magnetic induction B5000, under a magnetic field of 5000 A/m, is above or equal to 1.682 T.

5. A method of production of an annealed, cold-rolled, non grain-oriented Fe—Si steel sheet comprising the following steps:

melting a steel composition that contains in weight percentage:
C≤0.006%,
2.0%≤Si≤5.0%,
0.1%≤Al≤3.0%,
0.1%≤Mn≤3.0%,
N≤0.006%,
0.04%≤Sn≤0.2%,
S≤0.005%,
P≤0.2% and
Ti≤0.01%,
the balance being Fe and inevitable impurities;

casting the melt into a slab;

reheating the slab at a temperature between 1050° C. and 1250° C.;

hot rolling the slab with a hot rolling finishing temperature between 750° C. and 950° C. to obtain a hot rolled steel band;

coiling the hot rolled steel band at a temperature between 500° C. and 750° C.;

annealing the hot rolled steel band at a temperature between 650° C. and 750° C. for a time between 10s and 48 hours;

cold rolling the hot rolled steel band to obtain a cold rolled steel sheet;

heating the cold rolled steel sheet up to a soaking temperature between 850° C. and 1150° C.;

holding the cold rolled steel at the soaking temperature for a time between 20s and 100s; and cooling the cold rolled steel down to room temperature.

6. The method according to claim 5 wherein 2.0%≤Si≤3.5%.

7. The method according to claim 6 wherein 2.2%≤Si≤3.3%.

8. The method according to claim 5 wherein 0.2%≤Al≤1.5%.

9. The method according to claim 8 wherein 0.25%≤Al ≤1.1%.

10. The method according to claim 5 wherein 0.1%≤Mn≤1.0%.

11. The method according to claim 5 wherein 0.07%≤Sn≤0.15%.

12. The method according to claim 11 wherein 0.11%≤Sn≤0.15%.

13. The method according to claim 5 wherein the step of annealing is done using a continuous annealing line.

14. The method according to claim 5 wherein the step of annealing is done by batch annealing for a time between 24h and 48h.

15. The method according to claim 5 wherein the soaking temperature is between 900 and 1120° C.

16. The method according to claim 5 further comprising the step of:

coating the cold rolled steel sheet.

17. The method according to claim 5, wherein the steps are performed consecutively.

18. The method according to claim 5, wherein the steps of cold rolling the hot rolled steel band to obtain the cold rolled steel sheet; heating the cold rolled steel sheet up to the soaking temperature between 850° C. and 1150° C.; holding the cold rolled steel at the soaking temperature for the time between 20s and 100s; and cooling the cold rolled steel down to room temperature are performed consecutively.

19. The method according to claim 18, wherein the soaking temperature is between 900 and 1120° C.

20. A method of production of an annealed, cold-rolled, non grain-oriented Fe—Si steel sheet comprising the following steps:

melting a steel composition that contains in weight percentage:

C≤0.006%, 2.0%≤Si≤5.0%, 0.1%≤Al≤3.0%, 0.1%≤Mn≤3.0%,

N≤0.006%, 0.04%≤Sn≤0.2%,

S≤0.005%,

P≤0.2% and

Ti≤0.01%, the balance being Fe and inevitable impurities;

casting the melt into a slab;

reheating the slab at a temperature between 1050° C. and 1250° C.;

hot rolling the slab with a hot rolling finishing temperature between 750° C. and 950° C. to obtain a hot rolled steel band;

coiling the hot rolled steel band at a temperature between 500° C. and 750° C.;

and then consecutively performing the following steps:

cold rolling the hot rolled steel band to obtain a cold rolled steel sheet;

heating the cold rolled steel sheet up to a soaking temperature between 850° C. and 1150° C.;

holding the cold rolled steel at the soaking temperature for a time between 20s and 100s; and cooling the cold rolled steel down to room temperature.

21. The method according to claim 20, wherein the soaking temperature is between 900 and 1120° C.

* * * * *